US005405009A

United States Patent [19]

Hackenbracht

[11] Patent Number: 5,405,009

[45] Date of Patent: Apr. 11, 1995

[54] PROTECTIVE PACKAGE FOR CARAMEL APPLES

[75] Inventor: Charles G. Hackenbracht, New Philadelphia, Ohio

[73] Assignee: Tastee Apple Inc., Newcomerstown, Ohio

[21] Appl. No.: 288,971

[22] Filed: Aug. 9, 1994

Related U.S. Application Data

[63] Continuation of Ser. No. 105,012, Aug. 10, 1993, abandoned.

[51] Int. Cl.[6] ..... B65D 73/00

[52] U.S. Cl. ..... 206/470; 206/526; 206/508; 229/406; 220/4.22; 220/4.23; 220/339; 426/134; 426/119

[58] Field of Search ..... 206/470, 471, 459.5, 206/521.2, 521.8, 521.9, 525, 526, 807, 521.1, 508, 511; 229/2.5 R; 220/4.22, 4.23, 4.24, 339; 426/134, 110, 119

[56] References Cited

U.S. PATENT DOCUMENTS

| | | | |
|---|---|---|---|
| 3,257,062 | 6/1966 | Whiteford | 229/2.5 |
| 3,305,086 | 2/1967 | Hartman, Jr. | 426/119 |
| 4,494,650 | 1/1985 | Cullen | 229/2.5 |
| 4,650,076 | 3/1987 | Padovani | 206/591 |
| 4,732,273 | 3/1988 | DeMarco . | |
| 4,753,366 | 6/1988 | Ritter | 220/4.23 |
| 4,757,899 | 7/1988 | Magnussen, Jr. et al. | 206/521.9 |
| 4,795,080 | 1/1989 | McIntyre | 206/521.8 |
| 4,798,133 | 1/1989 | Johnson | 206/521.2 |
| 4,872,608 | 10/1989 | Lake | 206/521.8 |
| 4,886,204 | 12/1989 | Kalmanides | 206/470 |
| 5,046,659 | 9/1991 | Warburton | 220/4.23 |
| 5,165,947 | 11/1992 | Colucci et al. | 206/521.8 |
| 5,169,014 | 12/1992 | Hexamer | 220/4.22 |
| 5,232,094 | 8/1993 | Fagnant et al. | 206/471 |
| 5,269,430 | 12/1993 | Schlaupitz et al. | 220/339 |

FOREIGN PATENT DOCUMENTS

| | | | |
|---|---|---|---|
| 2236100 | 3/1991 | United Kingdom | 206/807 |
| 9112192 | 8/1991 | WIPO | 206/521.8 |

OTHER PUBLICATIONS

Tamper Evident Labeling, Product Brochure May 1983.

*Primary Examiner*—David T. Fidei
*Attorney, Agent, or Firm*—Renner, Otto, Boisselle & Sklar

[57] ABSTRACT

A package for a caramel apple, candy apple or the like includes a base having at least one recess for the receipt of an apple, a ridge extending substantially around the periphery of an open end of the base, and a first substantially flat outer surface abutting the ridge, and a cover accommodating a stick protruding from the apple and having a shoulder extending substantially around the periphery of an open end of the cover for sealing contact with the ridge of the base when the cover and the base are in a closed position, and a second substantially flat outer surface abutting the shoulder and being located adjacent the first substantially flat outer surface of the base to permit a single label to be affixed to an area of both of the first and the second substantially flat outer surfaces to maintain the package in a closed position and provide a tamper evident seal. Other embodiments of a protective package are also disclosed.

16 Claims, 3 Drawing Sheets

PROTECTIVE PACKAGE FOR CARAMEL APPLES

This is a continuation of application Ser. No. 08/105,012 filed on Aug. 10, 1993, now abandoned.

FIELD OF THE INVENTION

The present invention relates generally to a package or container and, more particularly, to a package or container for storing and displaying caramel and/or candy-coated apples and the like.

BACKGROUND OF THE INVENTION

Many different types of packages or containers for the storage and display of caramel or candy-coated apples and the like are known. One such container includes a base having a number of semi-spherical recesses or wells into which apples may be placed with the sticks inserted in the apples protruding from the base. An end piece or cap with a series of cylindrical extensions for the receipt of the exposed ends of the apple sticks is placed above the base containing the apples and atop the apple sticks. The entire package is then overwrapped with a polyethylene sheet that is heat shrunk around the package. This type of container suffers from being labor intensive since the exposed ends of the apple sticks must be fit into the cylindrical extensions in the end piece and the assembled package must be wrapped. Another disadvantage of this type of package is that it is not recloseable, i.e., once the polyethylene wrap has been removed it cannot be resealed or easily reclosed, thus exposing the apples to the elements. Moreover, if this type of package is stacked in a display, the sticks and apples support the weight of successive layers of packages. In time, the sticks will thus tend to shift within the apples and loosen from the apples, thus reducing the shelf life of the apples.

Another type of known package includes a pair of hinged halves with each half including a semi-spherical recess such that when the halves are closed, they substantially enclose an apple. One half further includes an upwardly extending top portion having a substantially linear recess in which the apple stick is disposed. When closed around the apple, the two halves are held together by a large label that completely covers the recess receiving the stick and overlaps the top edge of the other half of the container. Such a package does not provide a seal along the edges of the package running perpendicular to the hinge, thus permitting a gap to form between the halves which exposes the contents to the elements and intrusions by insects and the like. Further, this type of package is not tamper evident. The package is also not resealable or recloseable once the seal has been broken. Moreover, a plurality of the packages are not easily stackable.

Another known type of package includes a base and pivotally mounted cover which forms a seal when closed and a button snap which permits the package to be opened and resealed. However, this particular package is not suitable for packaging caramel or candy-coated apples, and thus would not allow for easy insertion and orientation of the apples within the package or the stacking of packages containing the apples in a display. Nor are such packages tamper evident.

It would be desirable to provide a protective package for caramel or candy-coated apples which is tamper evident, resealable and which can be readily stacked in a display. It would be further desirable if such a package could allow for easy insertion and orientation of the apples within the package.

SUMMARY OF THE INVENTION

The present invention provides a resealable package or container having a base and a cover which form a seal when closed. The base and cover are hinged and preferably include a button snap and a label covering a portion of both the base and cover to keep the package closed during shipping and display and provide evidence of tampering. The package is also readily stackable without subjecting the apples contained therein to the load of packages stacked above.

In accordance with one aspect of the invention, a package for caramel apples and the like includes a base defining a number of first recesses of a generally circular cross-section for the receipt of at least a part of an apple, and a cover pivotally mounted to the base and defining a number of generally frusto-conical shape second recesses for receipt of a stick protruding from the apple, which upon closure of the base and cover, tend to position the sticks protruding from the apples generally upright.

In accordance with another aspect of the invention, a package for a caramel apple and the like includes a base having at least one recess for the receipt of an apple, a ridge extending substantially around the periphery of an open end of the base, and a first substantially flat outer surface abutting the ridge; and a cover accommodating a stick protruding from the apple and having a shoulder extending substantially around the periphery of an open end of the cover for sealing contact with the ridge of the base when the cover and the base are in a closed position, and a second substantially flat outer surface abutting the shoulder and being located adjacent the first substantially flat outer surface of the base to permit a single label to be affixed to an area of each of the first and the second substantially flat outer surfaces to maintain the package in a closed position and provide a tamper evident seal.

In accordance with a further aspect of the invention, a stackable package for caramel apples and the like includes a base defining a number of first volumes of a generally circular cross-section each adapted for the receipt of at least a part of an apple, the bottom of the base having a circular raised platform located substantially at the center of the circular cross-section of each of the first volumes; and a cover pivotally mounted to the base and defining a number of generally frusto-conical shape second volumes in locations mirroring the locations of the first volumes in the base, each of the frusto-conical shape second volumes being truncated at a flat surface having a diameter to fit within a corresponding circular recess in the bottom of the raised platforms of the base.

The foregoing and other features of the invention are hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION OF THE PREFERRED EMBODIMENT OF THE INVENTION

Figure 1:
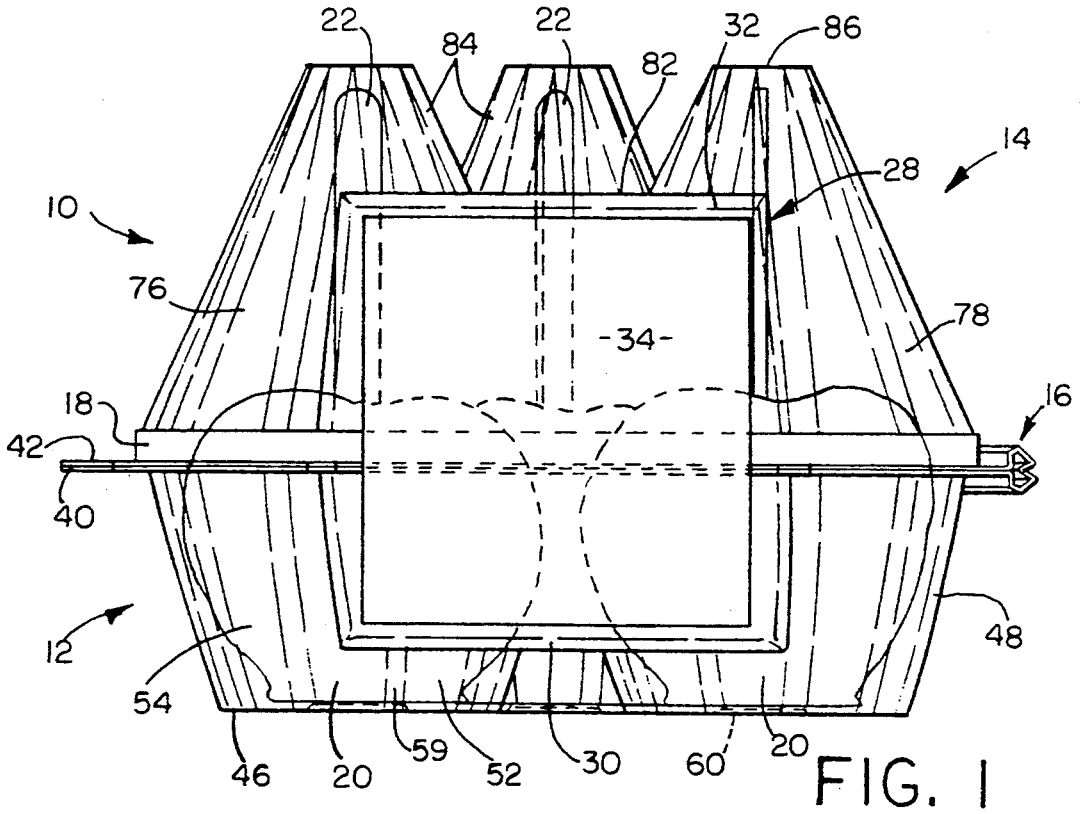
FIG. 1 is a side elevation view of the package of the present invention with the label area facing the viewer.

Referring to the several figures in which like reference numerals designate like items, and initially to FIG. 1, there is shown a preferred embodiment of the protective package of the present invention. The protective package 10 includes a base 12 and cover 14 pivotally mounted together through the hinge 16. At the point of joinder of the base 12 and cover 14, extending substantially completely around the periphery of the package 10 is a peripheral seal 18 which seals the contents of the package from the elements and prevents intrusion of insects and other material into the package when the base and cover are maintained in a closed condition.

The protective package 10 in the exemplary embodiment illustrated in FIG. 1 is adapted to receive three caramel apples 20 and attached sticks 22. However, the protective package of the present invention is not restricted to a package suitable for holding three apples. Rather, the principles of the invention may be adapted to packages containing one or more apples. Further, while the ensuing description refers to caramel apples, caramel apples are intended to be representative of both caramel and candy coated apples as well as other coated apples or fruit.

Figure 2:
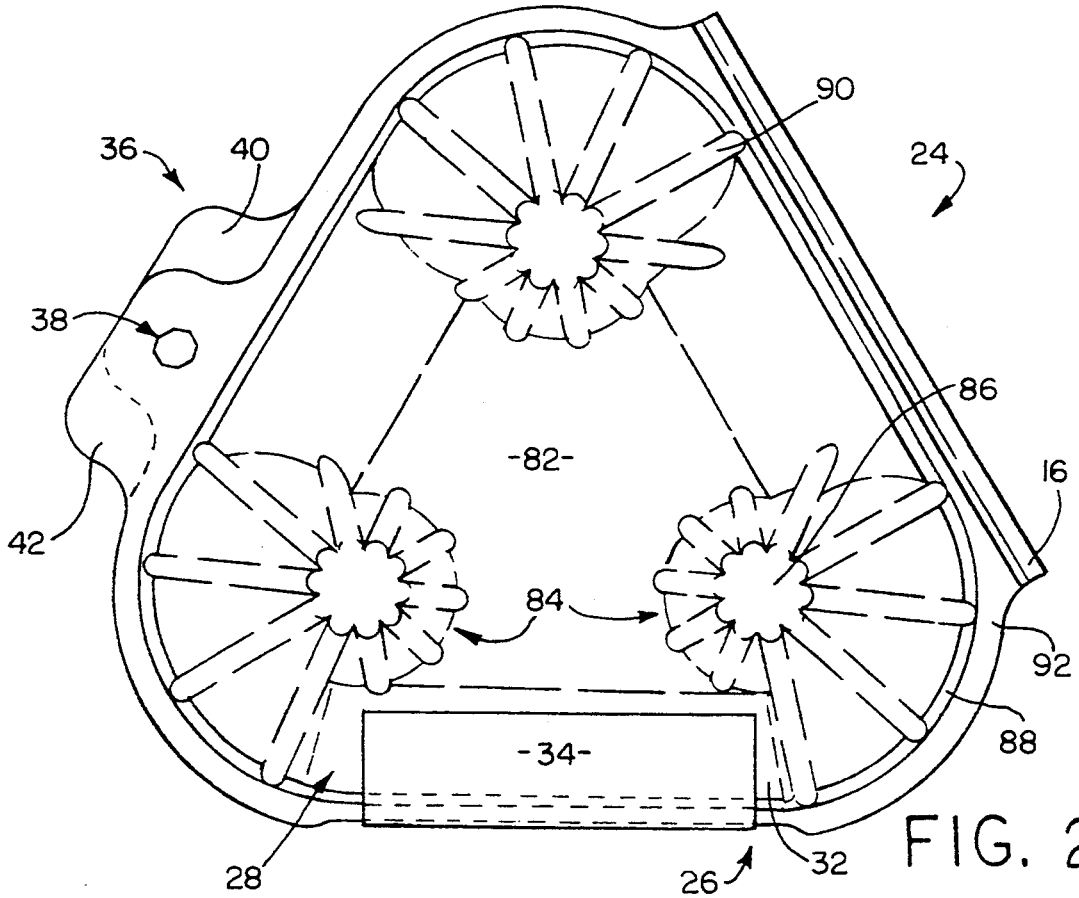
FIG. 2 is a top view of the package of FIG. 1.

The package 10 illustrated by way of example has a generally triangular outline when viewed from above to accommodate three apples, as shown in FIG. 2. The base 12 and cover 14 are joined together along one side 24 of the package 10 by the hinge 16 which preferably runs substantially the length of the side. Another side 26 includes a relatively large mounting surface 28 formed by substantially flat aligned areas 30, 32 on the base 12 and cover 14, respectively, upon which a single label 34 may be affixed. The third side 36 of the package 10 includes a button snap connector 38 formed in tabs 40, 42 extending from the base 12 and cover 14, respectively. The base 12 and cover 14 are thus held together in a sealed condition during shipping and display at the three sides 24, 26 and 36 by the hinge 16, the label 34 and the button snap 38.

Upon purchase, a consumer may open the package 10 by breaking or tearing the label 34 and by separating the button snap 38. As the package 10 can only be opened by breaking or tearing the label 34, the label renders the package tamper evident by providing a visual indication as to whether the package has been opened. After the package 10 has been opened and the label 34 broken, the package can still be reclosed and maintained closed in a sealed condition by the button snap 38. Consequently, the package remains insect proof, and freshness of the contents of the package 10 is preserved for a greater period of time than with packages that are not resealable.

Figure 3:
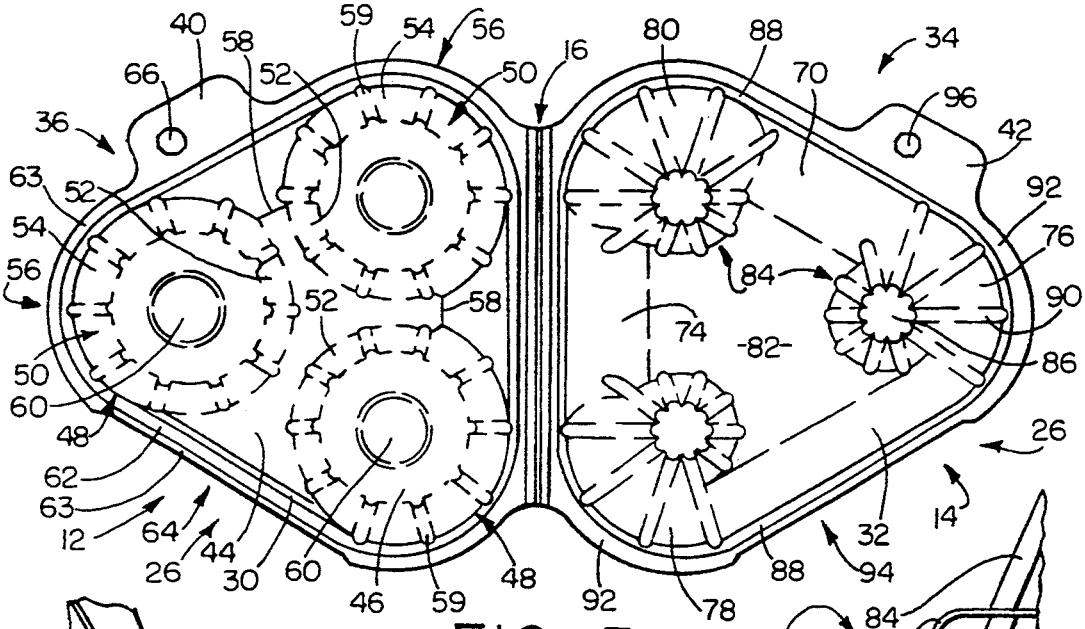
FIG. 3 is a reduced top view of the package in a completely open position.

FIG. 3 shows the package 10 in an open position. The base 12 is formed to create three open volumes, each of suitable size and shape to contain a major portion of a caramel apple 20. The base 12 generally includes a raised floor 44, a lower floor 46 and an upstanding wall 48 (also see FIGS. 1 and 5) which forms the three sides 24, 26 and 36 of the base. Projecting downwardly from the raised floor 44 and terminating at the lower floor 46 are three recesses 50 defining areas into which the base of an apple may be placed. The recesses 50 are disposed in a triangular array, thus lending to the generally triangular outline of the package 10, and each has a circular cross-section with the peripheries of the recesses being formed by a curved portion of the upstanding wall 48. Away from the periphery of the base 12, inner curved portions 52 of the recesses 50 terminate at the raised floor 44. Toward the periphery of the base 12, peripheral curved portions 54 of the upstanding wall 48 extend toward the uppermost part of the base and form the curved comers 56 where the three sides 24, 26 and 36 of the base meet. The upstanding wall 48 has relatively planar surfaces 58, recessed somewhat toward the center of the base 12 and extending from the raised floor 44 toward the top of the base, joining the peripheral curved portions 54 of the upstanding wall on the sides 24 (the hinged side) and 36. The upstanding wall 48 further includes the planar surface 30, upon which an area of the label 34 is affixed, which lies generally tangent to and joins the peripheral curved portions 54 of the upstanding wall on the side 26. Formed in the curved portions 52, 54 of the recesses 50 are ribs 59 to add structural rigidity to the base 12. The ribs 59 run from the lower floor 42 to the raised floor 44 along the inner curved portions 52 of the recesses 50 and extend to the uppermost portion of the base 12 along the peripheral curved portions 54 of the upstanding wall 48.

Preferably, the lower floor 46 includes generally circular raised platforms 60 at the center of each recess 50 on which the apples are placed to minimize contact between the apples and base to reduce scarring of the caramel coating. The undersides of the platforms 60 contain recesses 61 to facilitate stacking of a number of packages 10 as will be discussed later.

At the uppermost portion of the base 12, the upstanding wall 48 forms a centering ridge 62 which extends around the entire periphery of the base 12. Extending outwardly away from the centering ridge 62 is a flange 63. The flange 63 terminates in the hinge 16 along the side 24, includes a narrowed portion 64 facilitating application of the label 34 to the surface 28 on the side 26, and extends outwardly to form the tab 40 on the side 36 in which a cylindrical female snap portion 66 of the button snap 38 is formed.

The cover 14 is formed generally as a rounded frusto-pyramidal structure with planar walls 70, 32 and 74 lying tangent to three frusto-conical volumes which mirror the locations of the recesses 50 formed in the base 12 and define rounded comers 76, 78 and 80 of the frusto-pyramidal structure. The apexes of the frusto-conical volumes extend beyond the planar truncated ceiling 82 of the frusto-pyramidal structure defining smaller frusto-conical protrusions 84 which accommodate the ends of the apple sticks 22. The frusto-conical protrusions 84 terminate in circular planar surfaces 86 of a diameter slightly smaller than the diameter of the recesses 61 in the bottom of the circular platforms 60 located in the recesses 50 of the base 14. Preferably, the planar surfaces 86 are located a sufficient distance from the platforms 60 of the base 12 that, when apples 20 are properly placed in the recesses 50 in the base 12 with the sticks 22 extending upwardly and the package 10 is closed, there will be approximately a $\frac{1}{8}$ to $\frac{1}{4}$ inch clearance space between the tops of the sticks 22 protruding from the apples 20 and the circular planar surfaces 86.

The base of the frusto-pyramidal structure from which the walls 70, 32, 74 and corners 76, 78, 80 extend forms a shoulder 88 encircling the entire periphery of the cover 14 which mates with the centering ridge 62 of the base 12 to create a seal around the entire periphery of the package 10 and aid in maintaining the package in a closed position. The rounded corners 76, 78 and 80 and frusto-conical protrusions 84 are formed with ribs 90 extending along their lengths to provide added structural rigidity to the cover 14. The planar walls 70 and 74 slope inwardly from the shoulder 88 toward the ceiling 82 away from a plane lying tangent to the round corners 76, 80 and 78, 80, respectively. The planar wall 32 lies on a plane tangent to the round corners 76 and 78 to provide the flat surface to which a portion of the label 34 is affixed.

Extending outwardly from the shoulder 88 is a flange 92 which likewise encircles the periphery of the cover 14. The flange 92 terminates in the hinge 16 along the side 24, includes a narrowed portion 94 facilitating application of the label 34 to the surface 28 on the side 26, and extends outwardly to form the tab 42 on the side 36 in which a male button snap portion 96 of the button snap 38 is formed.

Figure 4:
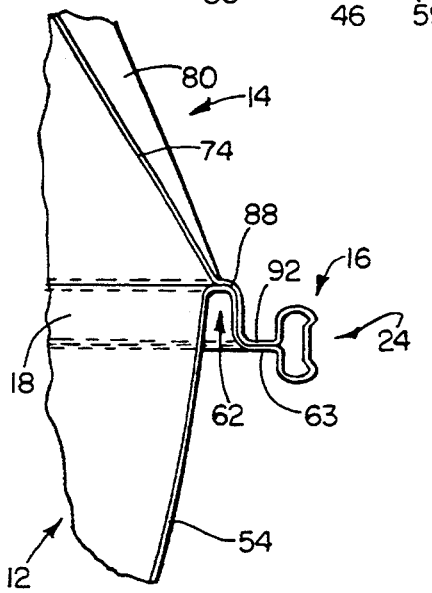
FIG. 4 is an enlarged partial cross-sectional view of the package through the hinge portion.
Figure 5:
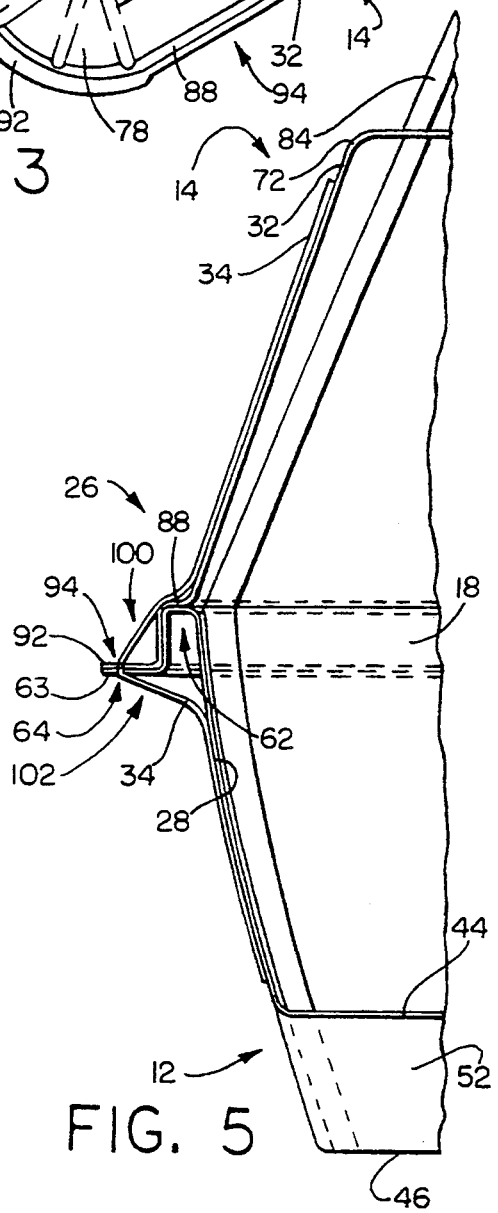
FIG. 5 is an enlarged partial cross-sectional view of the package taken through the area upon which the label is applied.
Figure 6:
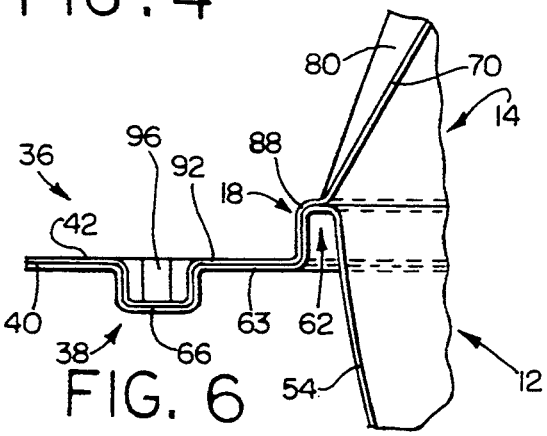
FIG. 6 is an enlarged partial cross-sectional view of the package illustrating the button snap.

As discussed above, the base 12 and cover 14 of the package 10 are held together in a sealed condition at all three sides 24, 26 and 36 before the package is ever opened by the hinge 16, the label 34 and the button snap 38, respectively, as is shown in detail in FIGS. 4, 5 and 6. FIG. 4 is an enlarged cross-section of the package 10 intersecting the hinge 16. The hinge 16 extends from the flanges 63 and 92 and is spaced from the seal 18 formed by the centering ridge 62 of the base 12 and shoulder 88 of the cover 14 so as not to obstruct the sealing action of the peripheral seal. The hinge 16 can be constructed in a number of ways which permit the base 12 and cover 14 to pivot relative to one another relatively easily. Preferably, the hinge 16 includes a number of corners and flat sections to accomplish the hinge action rather than employing a hinge formed by scoring or partially cutting through the plastic at the hinge point which tends to break after the package 10 is opened and closed a number of times.

FIG. 5 is an enlarged cross-section of the package 10 taken through the surface 28 upon which the label 34 is affixed. The surface area 30 of the base 12 and surface area 32 of the cover 14 cooperate to provide the relatively large flat surface 28 upon which a single label 34 may be affixed when the package 10 is closed. The flanges 63 and 92 extending from the centering ridge 62 of the base 12 and shoulder 88 of the cover 14 are narrowed in the areas 64, 94 to facilitate the label 34 passing over the flanges. When in place, the label 34 holds the base 12 and cover 14 together along the side 26 of the package 10. To permit opening of the package 10, the label 34 may be torn or broken at the areas 100 or 102 where the label is not in direct contact with the package 10.

FIG. 6 is an enlarged cross-section of the package 10 taken through the portions of the tabs 40 and 42 of the base 12 and cover 14, respectively, which form the button snap 38. The tabs 40 and 42 are extensions of the flanges 63 and 92 and permit opening and closure of the seal 18 formed by the centering ridge 62 of the base and shoulder 88 of the cover. The female portion 66 of the button snap 38 is preferably formed as a cylindrical recess in the tab 40. The male portion 96 of the button snap 38 is formed in the tab 42 of the cover 14 as a polygonal shape, for example, octagonal shape, projection having an outer dimension which enables the projection to fit snugly into the female portion 66 of the button snap. By snapping the male and female portions 96 and 66 of the button snap 38 together, the tabs 40 and 42 are held together thus maintaining the centering ridge 62 of the base 12 and the shoulder 88 of the cover 14 in engagement. Once the label 34 has been torn or broken, the package 10 may be opened by grasping the tabs 40, 42, which are offset as shown in FIG. 2 at their noncontacting portions and separating the tabs thereby separating the centering ridge 62 of the base 12 and shoulder 88 of the cover 14.

The package 10 is preferably made of a transparent crystalline polystyrene material with a small amount of a rubberizing agent added to make the package less brittle and easier to mold. The package is preferably formed from a sheet of crystalline polystyrene which is heated and then vacuum formed in a thermoforming process. The thermoformed plastic package is then placed in a punch press where the outer periphery of the base 12 and cover 14 are trimmed to leave the flanges 63 and 92, respectively. It is preferable that the flanges 63 and 92 are of a relatively large size, except for in the narrowed portions 64 and 94, to facilitate the punching operation, to add stability to the edges of the package 10, and to maintain the correct relative positioning between the centering ridge 62 of the base 12 and the shoulder 88 of the cover 14. The package may also be constructed of a vinyl plastic or other similar material using a thermoforming or similar process. In any case the material of the package is desirably transparent to permit the entire contents of the package to be visible to the consumer.

Figure 7:
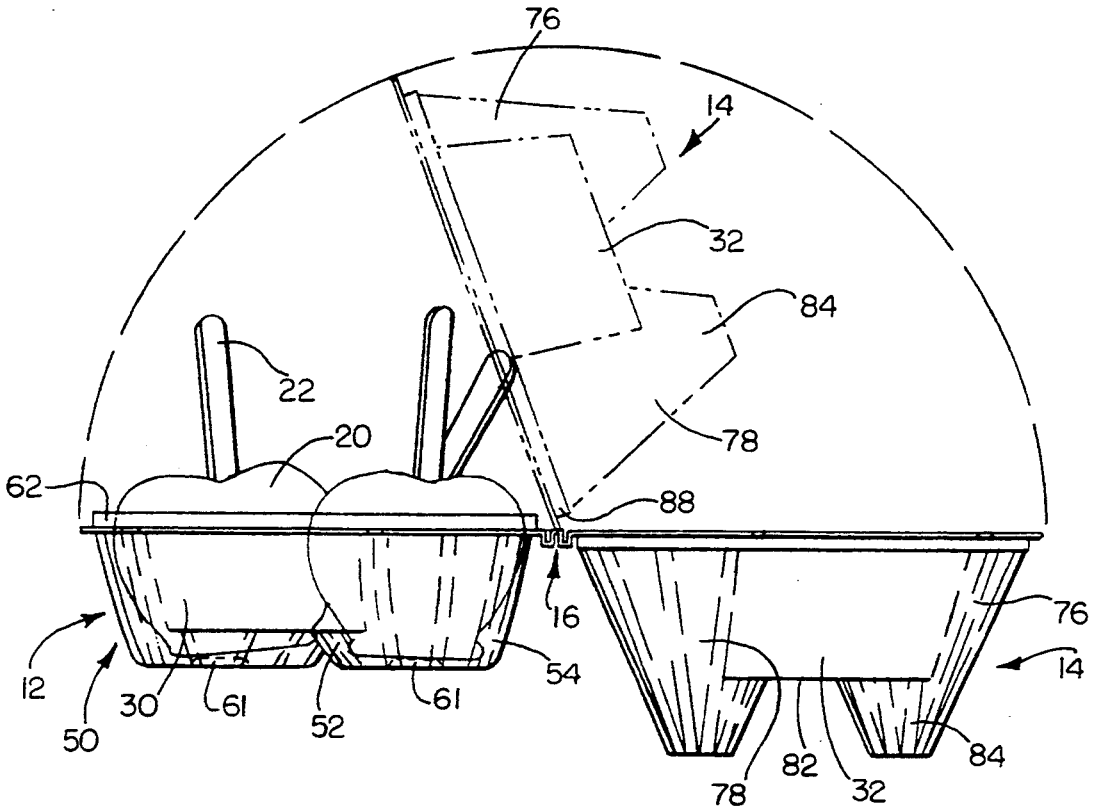
FIG. 7 is a reduced side elevation view of the package in an open position with apples in the base portion and further illustrating the cover in phantom in a partially closed position.

One advantage of the package 10 is that it is easy to place the apples 20 within the package and close and seal the package. When apples 20 with inserted sticks 22 are placed within the recesses 50 of the base 12, excessive time need not be devoted to ensuring that the apples and sticks are near perfectly vertical since when the cover 14 is rotated about the hinge 16 to close upon the base 12, the generally frusto-conical volumes formed by the rounded corners 76, 78 and 80 and protrusions 84 tend to guide the apple sticks into a correct relative positioning within the package, as is shown in FIG. 7. (The package 10 is shown in FIG. 7 in a partially closed position by phantom lines.) Upon full closure, the sticks 22 are guided to fit within the frusto-conical protrusions 84 and to be approximately one-eighth to one-quarter inch from the planar surfaces 86, such as is shown in FIG. 1. Upon full closure, the shoulder 88 of the cover 14 engages the centering ridge 62 of the base 12 sealing the package 10. The button snap 38 may then be closed, and the label 34 may be applied to the surface 28 to maintain the package in its closed and sealed condition.

Figure 8:
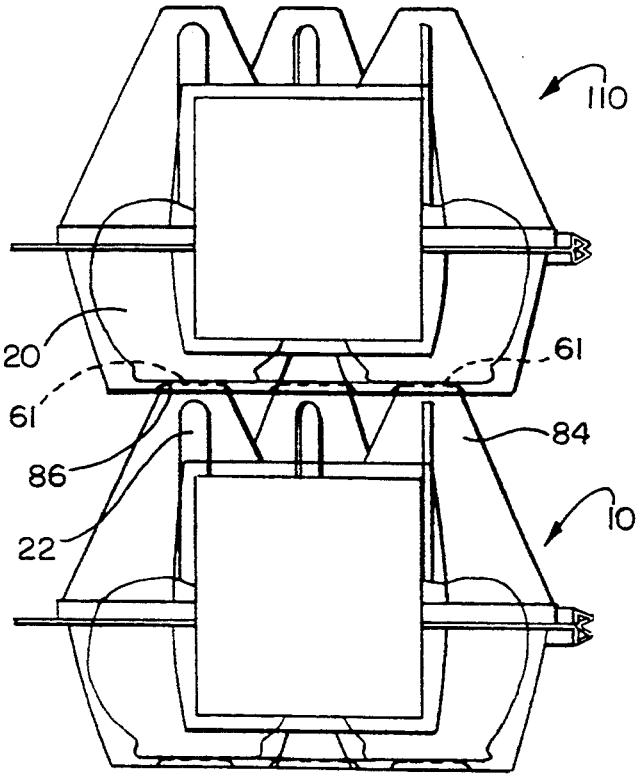
FIG. 8 is a reduced side elevation view of two packages stacked one atop the other.

The package 10 also offers the advantage of being easily stackable with the package bearing the weight of other packages stacked upon it, rather than the apples and sticks, such as shown in FIG. 8. As noted above, preferably the floor 46 of the base 12 is provided with raised platforms 60 which have recesses 61 in the bottom of the platforms. The circular planar surfaces 86, which form the tops of the frusto-conical protrusions 84, have a diameter slightly smaller than the diameter of the recessed areas 61 in the bottoms of the platforms 60. Thus, when multiple packages 10, 110 are stacked one upon another as shown in FIG. 8, the tops 86 of the frusto-conical protrusions 84 are accommodated by the recesses 61 in the bottoms of the circular platforms 60 in the base of the package stacked above to provide stability to the stacked packages and resistance to movement. Moreover, as noted above, since the package supports the weight of further packages stacked upon it, the stability of the stacked packages does not diminish over time as it often would in packages where the apples 20 and sticks 22 support the weight of packages stacked upon it. Additionally, since the apples and sticks are not used to bear the weight of packages stacked thereabove, the shelf life of the apples is further extended since the sticks will not tend to shift within and loosen from the apples.

What is claimed:

1. A package for caramel or candy coated apples having a stick protruding from each apple comprising a base including means for forming a plurality of first recesses of a generally circular cross-section each for receipt of at least part of an apple, and a cover pivotally connected to said base by a hinge, said cover including means for forming a plurality of generally frusto-conical shape second recesses each for receipt of a stick protruding from each apple, said frusto-conical shape second recesses having sloping sides that assist in positioning the sticks protruding from the apples in a substantially upright orientation during pivotal closing of said package.

2. The package of claim 1 wherein said base and said cover each include substantially flat aligned surfaces upon which a single label is affixed upon closure of said base and said cover to maintain said package in a closed position and provide a tamper-evident seal, said substantially flat aligned surfaces being circumferentially spaced from said hinge.

3. The package of claim 1 further comprising a ridge extending substantially around the periphery of an open end of said base, and a first substantially flat outer surface abutting said ridge, a shoulder extending substantially around the periphery of an open end of said cover for sealing contact with said ridge of said base when said cover and said base are in a closed position, and a second substantially flat outer surface abutting said shoulder and located adjacent said first substantially flat outer surface of said base upon closure of said base and said cover upon which a single label is affixed to an area of both of said first and said second substantially flat outer surfaces to maintain said package in a closed position and provide a tamper-evident seal, said first and said second substantially flat outer surfaces being circumferentially spaced from said hinge.

4. The package of claim 3 further comprising means for forming flanges extending radially outwardly from said ridge and said shoulder around the periphery of said base and said cover, respectively, said flanges engaging each other upon closure of said base and said cover, said flanges including narrowed portions in alignment with said first and said second substantially flat outer surfaces to facilitate affixing of said single label to said surfaces upon closure of said base and said cover.

5. The package of claim 4 wherein said flanges include extensions circumferentially spaced from said narrowed portions and said hinge providing tabs in which respective portions of a button snap are provided for reclosably maintaining said package in a closed position.

6. The package of claim 3 wherein said base and said cover are of generally triangular shape each including first, second and third sides, said first sides of said base and said cover being joined together by said hinge, said second sides of said base and said cover including respective portions of a button snap for reclosably maintaining said package in a closed position along said second sides, and said third sides of said base and said cover including said first and said second substantially flat outer surfaces upon which said single label is affixed upon closure of said base and said cover to hold said package in a closed and sealed condition during shipping and display at said first, second and third sides by said hinge, said button snap, and said label respectively.

7. The package of claim 1 wherein said base includes a bottom having circular recesses located substantially at the center of the circular cross-section of each of said first recesses, and each of said frusto-conical shape second recesses are truncated at a flat surface and have a diameter of a size to fit within a corresponding circular recess in the bottom of said base for stacking of said packages one on top of another when closed, the distance from the bottom of said base to said flat surfaces of said frusto-conical shape second recesses of said cover being greater than the height of the apples and protruding sticks when said package is closed.

8. The package of claim 7 wherein said circular recesses in said bottom of said base provide raised platforms within said first recesses on which the apples are placed to minimize contact between the apples and said base to reduce scarring of the caramel or candy coating on the apples.

9. A stackable package for caramel or candy coated apples each having a stick protruding therefrom comprising a base including means for forming a plurality of first recesses of a generally circular cross-section each for receipt of at least a part of an apple, said base including a bottom having circular recesses located substantially at the center of the circular cross-section of each of said first recesses, and a cover pivotally connected to said base by a hinge, said cover including means for forming a plurality of generally frusto-conical shape second recesses in locations mirroring the locations of said first recesses in said base upon closure of said base and said cover, each of said second frusto-conical shape recesses in said cover having sloping sides that tend to position the sticks protruding from the apples in a substantially upright orientation during closing of said package, each of said frusto-conical shape second recesses being truncated at a flat surface and having a diameter of a size to fit within corresponding circular recesses in the bottom of said base for stacking of said packages one on top of another when closed.

10. The package of claim 9 wherein said circular recesses in said bottom of said base providing raised platforms within said first recesses on which the apples are placed to minimize contact between the apples and said base to reduce scarring of the caramel or candy coating on the apples.

11. A package for caramel or candy coated apples having a stick protruding from each apple comprising a base including a raised floor having a plurality of first recesses of generally circular cross section extending below said raised floor each for receipt of at least part of an apple, and a first outer wall extending around the periphery of said base and above said raised floor, said base having an interior space which is completely open above said raised floor, and a cover pivotally connected to said base, said cover including a plurality of generally frusto-conical shape second recesses each for receipt of a stick protruding from each apple, said second recesses having sloping sides that assist in positioning the sticks protruding from the apples in a substantially upright orientation during pivotal closing of said package.

12. The package of claim 11 wherein said first outer wall of said base includes a first wall portion forming an extension of a first exterior wall of each of said first recesses above said raised floor.

13. The package of claim 11 wherein said cover includes a planar ceiling above which said second recesses extend, said cover having an interior space which is completely open below said ceiling.

14. The package of claim 13 wherein said cover includes a second outer wall extending around the periphery of said cover and below said ceiling.

15. The package of claim 14 wherein said second outer wall includes a second wall portion forming an extension of an exterior wall of each of said second recesses.

16. The package of claim 11 wherein said base includes a lower floor below said raised floor, said first recesses terminating at said lower floor.

* * * * *